US010605540B2

(12) United States Patent
Tseng et al.

(10) Patent No.: US 10,605,540 B2
(45) Date of Patent: Mar. 31, 2020

(54) VAPOR CHAMBER THAT UTILIZES A CAPILLARY STRUCTURE AND BUMPS TO FORM A LIQUID-VAPOR CHANNEL

(71) Applicant: TAI-SOL ELECTRONICS CO., LTD., Taipei (TW)

(72) Inventors: Chuan-Chi Tseng, Taipei (TW); Wen-Ching Liao, Taipei (TW); Ming-Quan Cui, Wujiang (CN)

(73) Assignee: TAI-SOL ELECTRONICS CO., LTD., Taipei (TW)

( * ) Notice: Subject to any disclaimer, the term of this patent is extended or adjusted under 35 U.S.C. 154(b) by 84 days.

(21) Appl. No.: 16/103,126

(22) Filed: Aug. 14, 2018

(65) Prior Publication Data

US 2020/0003498 A1 Jan. 2, 2020

(30) Foreign Application Priority Data

Jun. 28, 2018 (TW) ..... 107122343 A

(51) Int. Cl.

| | |
|---|---|
| ***F28D 15/00*** | (2006.01) |
| ***F28D 15/04*** | (2006.01) |
| ***F28D 15/02*** | (2006.01) |
| ***F28F 3/12*** | (2006.01) |

(52) U.S. Cl.

CPC ..... *F28D 15/046* (2013.01); *F28D 15/0233* (2013.01); *F28F 3/12* (2013.01); *F28F 2270/00* (2013.01)

(58) Field of Classification Search

CPC ..... F28D 15/046; F28D 15/0233; F28F 3/12; F28F 2270/00

USPC ..... 165/104

See application file for complete search history.

(56) References Cited

U.S. PATENT DOCUMENTS

2014/0246176 A1* 9/2014 Yang ..... F28F 13/00 165/104.26
2014/0311706 A1* 10/2014 Tenzler ..... F28D 15/046 165/61
2018/0142961 A1* 5/2018 Wu ..... F28D 15/0266
2018/0356156 A1* 12/2018 Hurbi ..... F28C 3/08

FOREIGN PATENT DOCUMENTS

TW I476361 B 3/2015
TW M532046 U 11/2016

* cited by examiner

*Primary Examiner* — Davis D Hwu

(74) *Attorney, Agent, or Firm* — Muncy, Geissler, Olds & Lowe, P.C.

(57) ABSTRACT

A vapor chamber includes a first panel defining an evaporation region, a thermal insulation region and a condensation region, a second panel joined to the first panel to define an enclosed accommodation space therebetween, a capillary material disposed in the accommodation space, and a working fluid. The first panel has a plurality of first bumps disposed within the accommodation space and distributed in the evaporation region, the thermal insulation region and the condensation region and abutted against the capillary material. The capillary material has a hollow portion located in the thermal insulation region to expose a part of the first bumps. The second panel has a plurality of second bumps abutted against the first bumps in the hollow portion.

9 Claims, 9 Drawing Sheets

VAPOR CHAMBER THAT UTILIZES A CAPILLARY STRUCTURE AND BUMPS TO FORM A LIQUID-VAPOR CHANNEL

BACKGROUND OF THE INVENTION

1. Field of the Invention

The present invention relates to vapor chamber technology and more particularly, to such a vapor chamber that utilizes a capillary structure and bumps to form a liquid-vapor channel.

2. Description of the Related Art

A known vapor chamber generally comprises two panel members that are arranged in a stack with the borders thereof bonded together to define an enclosed chamber therein, and a capillary structure and a working fluid disposed in the enclosed chamber. The effect of uniform temperature heat conduction is achieved by the conversion of the liquid phase and the gas phase of the working fluid.

Taiwan Patent No. I476361 discloses a vapor chamber capillary formation method and structure that has a plurality of supporting protrusions inside, which can provide support strength and achieve uniform temperature and heat conduction effects. However, this technique does not have a diversion effect on the internal gas phase working fluid and liquid phase working fluid, it just lets the internal gas phase working fluid and liquid phase working fluid flow freely and cannot effectively improve the heat conduction and temperature equalization effects.

Taiwan Patent No. M532046 discloses a vapor chamber with liquid-vapor separation structure. It mainly proposes a diversion technique for liquid phase working fluid and gas phase working fluid to increase the heat conduction and temperature uniformity of the vapor chamber. However, the arrangement of the gas phase channel and the liquid phase channel of this technique cannot be applied to any design that requires an ultra-thin space. The main reason is that the liquid phase channel is established by using fiber bundles, and in the evaporation region and the condensation region, another layer of capillary material is needed to contact the fiber bundles. Because this structure uses two kinds of capillary materials and requires a certain thickness to construct the liquid phase channel, it is difficult to make the structure thin.

SUMMARY OF THE INVENTION

The present invention has been accomplished under the circumstances in view. It is the main object of the present invention to provide a vapor chamber, which utilizes a capillary structure and bumps to form liquid vapor channels, providing a flow guiding effect to both the gas phase working fluid and the liquid phase working fluid, and making the overall structure thin to satisfy ultra-thin space requirements.

To achieve this and other objects of the present invention, a vapor chamber comprises a first panel, a second panel, a capillary material and a working fluid. The first panel defines an evaporation region, a thermal insulation region and a condensation region. The thermal insulation region is adjacent to the evaporation region and the condensation region respectively. The evaporation region and the condensation region are spaced from each other. The second panel is joined to the first panel with an enclosed accommodation space defined therebetween. The capillary material is made in the form of a flake and located in the accommodation space. The working fluid is filled in the accommodation space. Further, the first panel comprises a plurality of first bumps located on a panel surface thereof within the accommodation space and distributed in the evaporation region, the thermal insulation region and the condensation region and abutted against the capillary material. The capillary material comprises a hollow portion located in the thermal insulation region to expose a part of the first bumps and to define a vapor channel therein. The capillary material has a part thereof located in the thermal insulation region to form at least one liquid channel. The second panel comprises a plurality of second bumps located on a panel surface thereof within the accommodation space. The second bumps are disposed in the hollow portion to abut against said first bumps.

Therefore, the present invention constructs a vapor channel and at least one liquid channel and can provide a flow guiding effect to guide both the gas phase working fluid and the liquid phase working fluid and can be thinned to satisfy ultra-thin space requirement.

Preferably, the number of the first bumps per unit area within the hollow portion is less than the number of the first bumps per unit area beyond the hollow portion.

Preferably, the first bumps in the hollow portion are elongated with respective two opposite ends thereof facing the evaporation region and the condensation region respectively.

Preferably, the first bumps are arranged in multiple rows along the length direction thereof.

Preferably, the second bumps are elongated with respective two opposite ends thereof facing the evaporation region and the condensation region respectively.

Preferably, the first panel further comprises at least one blocker disposed in the thermal insulation region and abutted against the capillary material in the thermal insulation region to spatially block the space between the evaporation region and the thermal insulation region, making the evaporation region spatially disjoint with a part of the thermal insulation region.

Preferably, the at least one blocker is boss-shaped and abutted with a top surface thereof against the capillary material in the thermal insulation region to fill up the space between the capillary material in the thermal insulation region and the first panel.

Preferably, the at least one blocker is made in the form of an upright wall and abutted with a top edge thereof against the capillary material in the thermal insulation region.

Preferably, the at least one blocker spatially blocks the space between the evaporation region, the capillary material in the thermal insulation region and the first panel and also blocks the space between the vapor channel, the capillary material in the thermal insulation region and the first panel.

Other advantages and features of the present invention will be fully understood by reference to the following specification in conjunction with the accompanying drawings, in which like reference signs denote like components of structure.

DETAILED DESCRIPTION OF THE INVENTION

Figure 1:
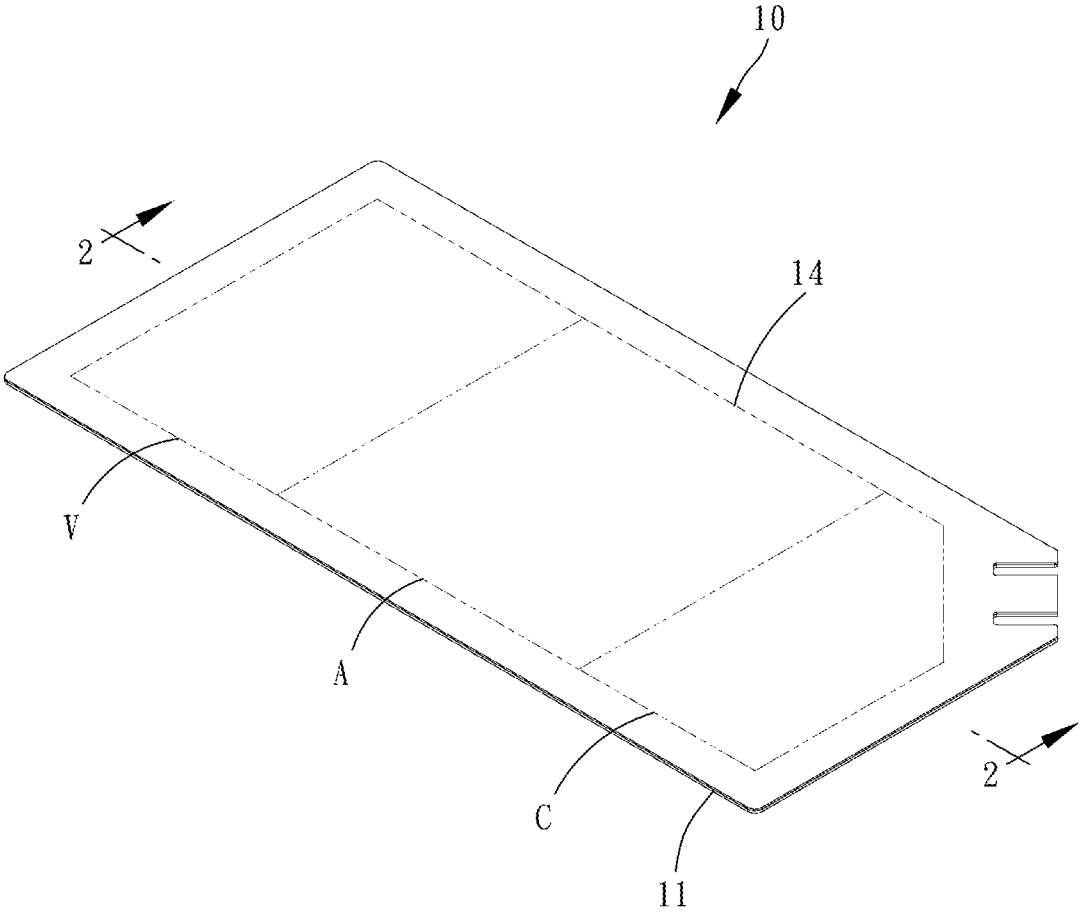
FIG. 1 is an assembly view of a vapor chamber in accordance with a first embodiment of the present invention.
Figure 2:
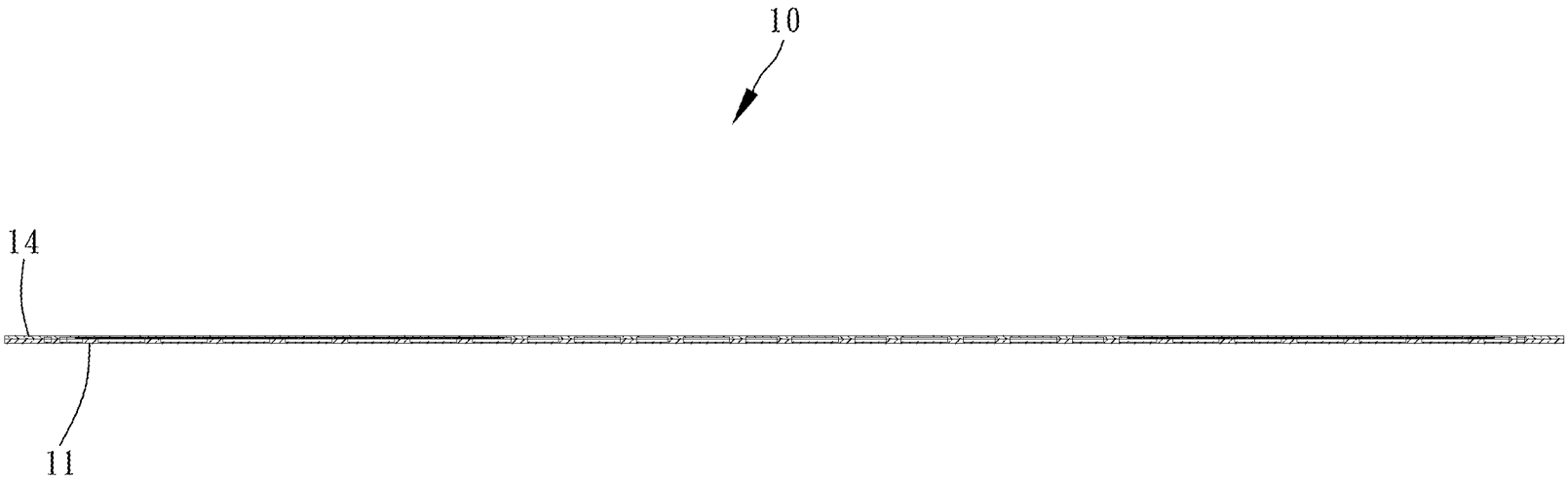
FIG. 2 is a sectional view taken along line 2-2 of FIG. 1.
Figure 3:
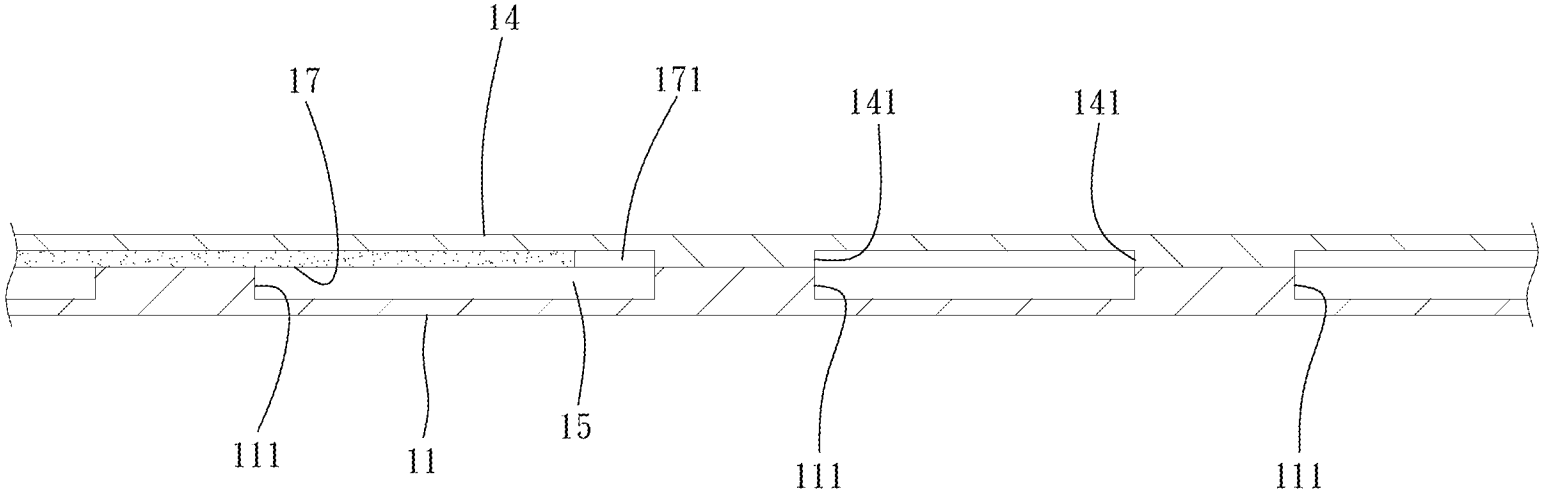
FIG. 3 is an enlarged view of a part of FIG. 2.

Referring to FIGS. 1-5, a vapor chamber 10 in accordance with a first embodiment of the present invention is shown. The vapor chamber 10 is composed of a first panel 11, a second panel 14, a capillary material 17 and a working fluid.

The first panel 11 defines an evaporation region V, a thermal insulation region A and a condensation region C. The thermal insulation region A is adjacent to the evaporation region V and the condensation region C respectively, and the evaporation region V is not adjacent to the condensation region C.

The second panel 14 is jointed to the first panel 11, defining an enclosed accommodation space 15 therebetween.

The capillary material 17, in the form of a flake, is located in the accommodation space 15. In actual implementation, the capillary material 17 can be selected from a woven copper mesh or a copper powder sintered material and can be directly disposed on the second panel 14.

The working fluid is filled in the accommodation space 15. Since the working fluid is adsorbed in the capillary material 17, the drawing is difficult to represent, and it is a necessary component that can be understood by those skilled in the art, so it is not represented by the schema.

Further, the first panel 11 comprises a plurality of first bumps 111 located on a panel surface thereof within the accommodation space 15, and these first bumps 111 are distributed in the evaporation region V, the thermal insulation region A and the condensation region C and are abutted against the capillary material 17.

The capillary material 17 has a hollow portion 171, and the hollow portion 171 is located in the thermal insulation region A. In the hollow portion 171, a part of the first bumps 111 is exposed, and a vapor channel GC is formed in the hollow portion 171. The part of the capillary material 17 located in the thermal insulation region A forms two liquid channels LC that are located on both sides of the vapor channel GC.

The second panel 14 has a plurality of second bump 141 located on a panel surface thereof within the accommodation space 15, and these second bumps 141 are disposed in the hollow portion 171 to abut against the exposed first bumps 111.

The structure of the first embodiment of the present invention has been described above, and the working state of the first embodiment will be described hereinafter.

Figure 4:
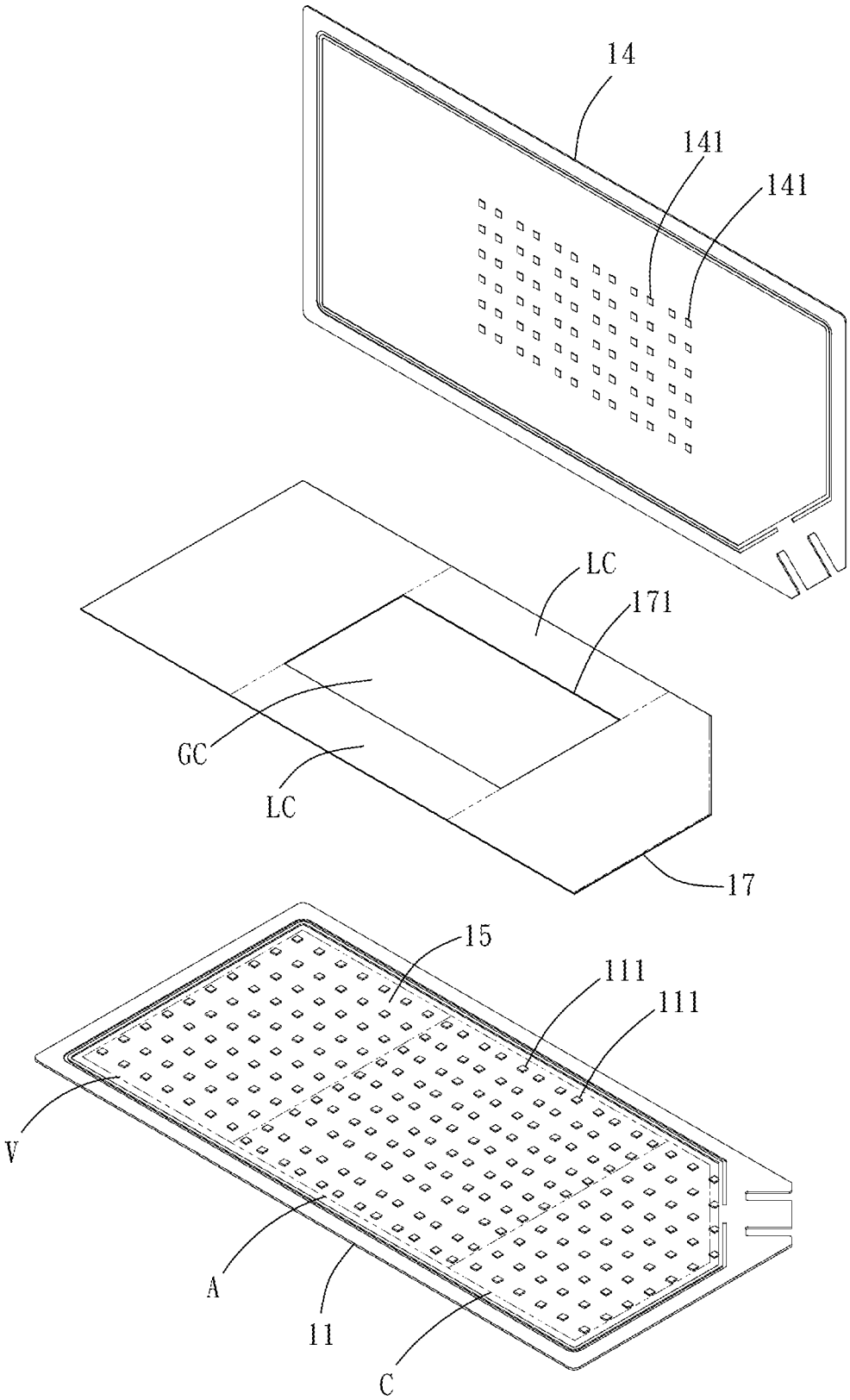
FIG. 4 is an exploded view of the vapor chamber in accordance with the first embodiment of the present invention.
Figure 5:
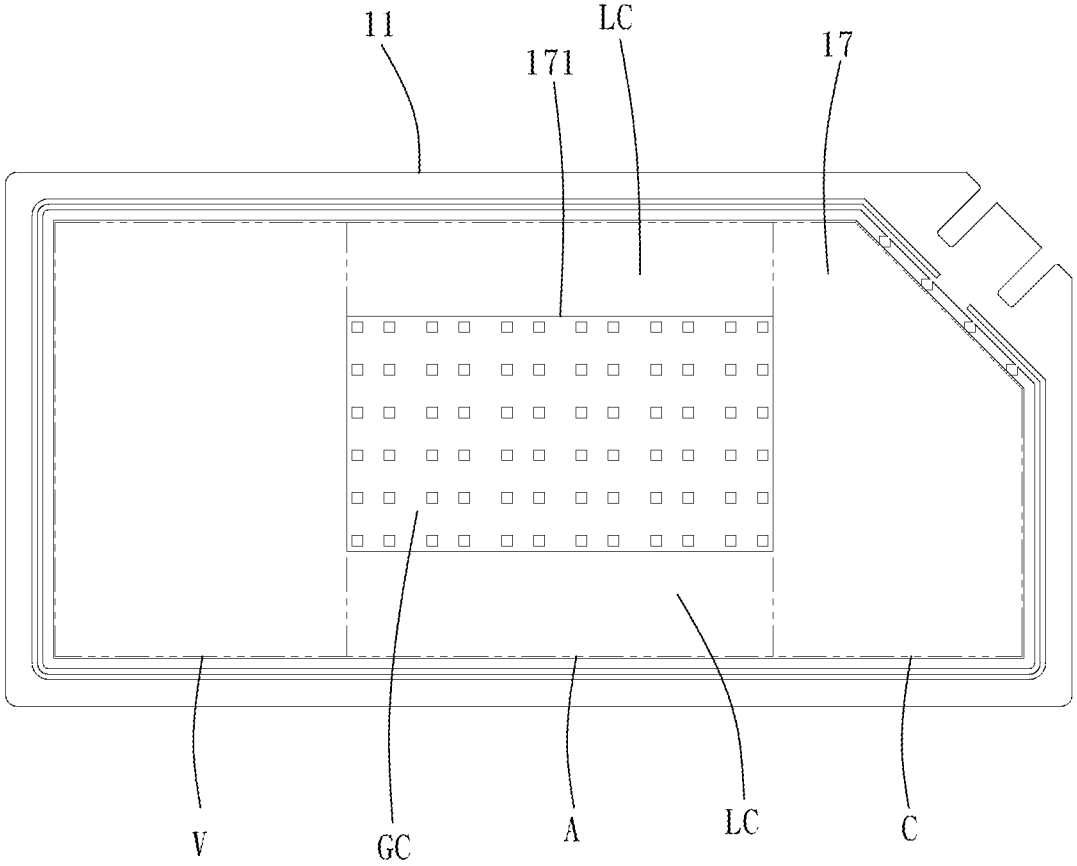
FIG. 5 is a top view of the first embodiment of the present invention after removal of the second panel.

Referring to FIG. 4 and FIG. 5, in application, attach the vapor chamber 10 to a heat source (not shown), for example, the CPU of a personal computer, enabling the evaporation region V to face toward the heat source. When the heat source is hot, the working fluid adsorbed by the capillary material 17 in the evaporation region V is heated to evaporate into a gas phase working fluid.

Since vapor channel GC is formed in the hollow portion 171 of the capillary material 17, there is no capillary structure, only the space between the first panel 11 and the second panel 14 and the abutment structure between a limited number of the first bumps 111 and a limited number of the second bumps 141, and therefore, the cross-sectional area of the space here is larger. Since the capillary material 17 occupies a partial cross-sectional area, the spatial cross-sectional area between the capillary material 17 and the first panel 11 in the thermal insulation region A is smaller than the cross-sectional area of the vapor channel GC described above. Due to the difference in the cross-sectional area described above, the gas phase working fluid in the evaporation region V will flow to a position with a large cross-sectional area due to the pressure difference, so most of the gas phase working fluid flows from the vapor channel GC to the condensation region C. When the gas phase working fluid flows in the space in the condensation region C between the capillary material 17 and the first panel 11, it is condensed into the liquid phase and absorbed by the capillary material 17, and the liquid phase working fluid quickly returns to the evaporation region V via the two liquid channels LC using capillarity. With this continuous cycle, the effect of uniform temperature and heat conduction can be achieved.

In the above working state, since the vapor channel GC can attract most of the gas phase working fluid, it can exert a diversion effect on the gas phase working fluid, so that the gas phase working fluid can be easily guided to the vapor channel GC to enter the condensation region C. Further, since the liquid phase working fluid flows back to the evaporation region V via the two liquid channels LC, the two liquid channels LC play a guide role to guide the liquid phase working fluid. Further, since the gas phase working fluid between the capillary material 17 in the two liquid channel LC and the first panel 11 is relatively small, it does not affect the reflux of the liquid phase working fluid. The architecture of the first embodiment can be applied to ultra-thin space requirements because the internal structure and space are formed only by the capillary material 17 and the bumps.

Figure 6:
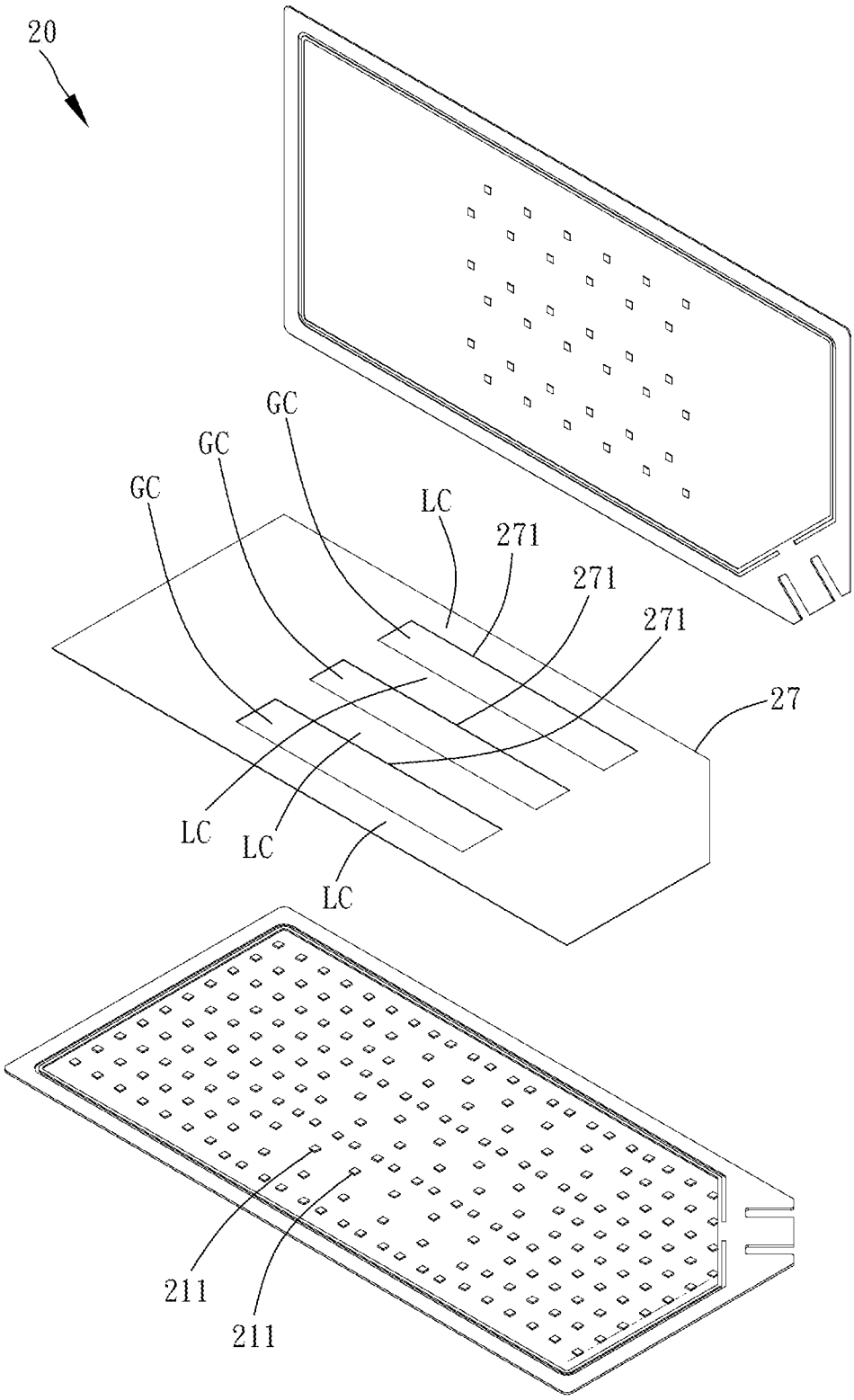
FIG. 6 is an exploded view of a vapor chamber in accordance with a second embodiment of the present invention.

FIG. 6 illustrates a vapor chamber 20 in accordance with a second embodiment of the present invention. This second embodiment is substantially similar to the aforesaid first embodiment with the exceptions as outlined hereinafter.

The capillary material 27 has three hollow portions 271, thereby forming three vapor channels GC to improve the effect of guiding the gas phase working fluid. Further, the capillary material 27 has four liquid channels LC spaced from the three vapor channels GC.

The number of the first bumps 211 located in the three hollow portions 271 per unit area is less than the number of the first bumps 211 per unit area beyond the hollow portions 271. In this way, the volume of the first three vapor channels GC occupied by the first bumps 211 can be reduced, and the three vapor channels GC can provide more space to guide the gas phase working fluid. The remaining structure of this second embodiment and the achievable effects are the same as those of the first embodiment and will not be described again.

Figure 7:
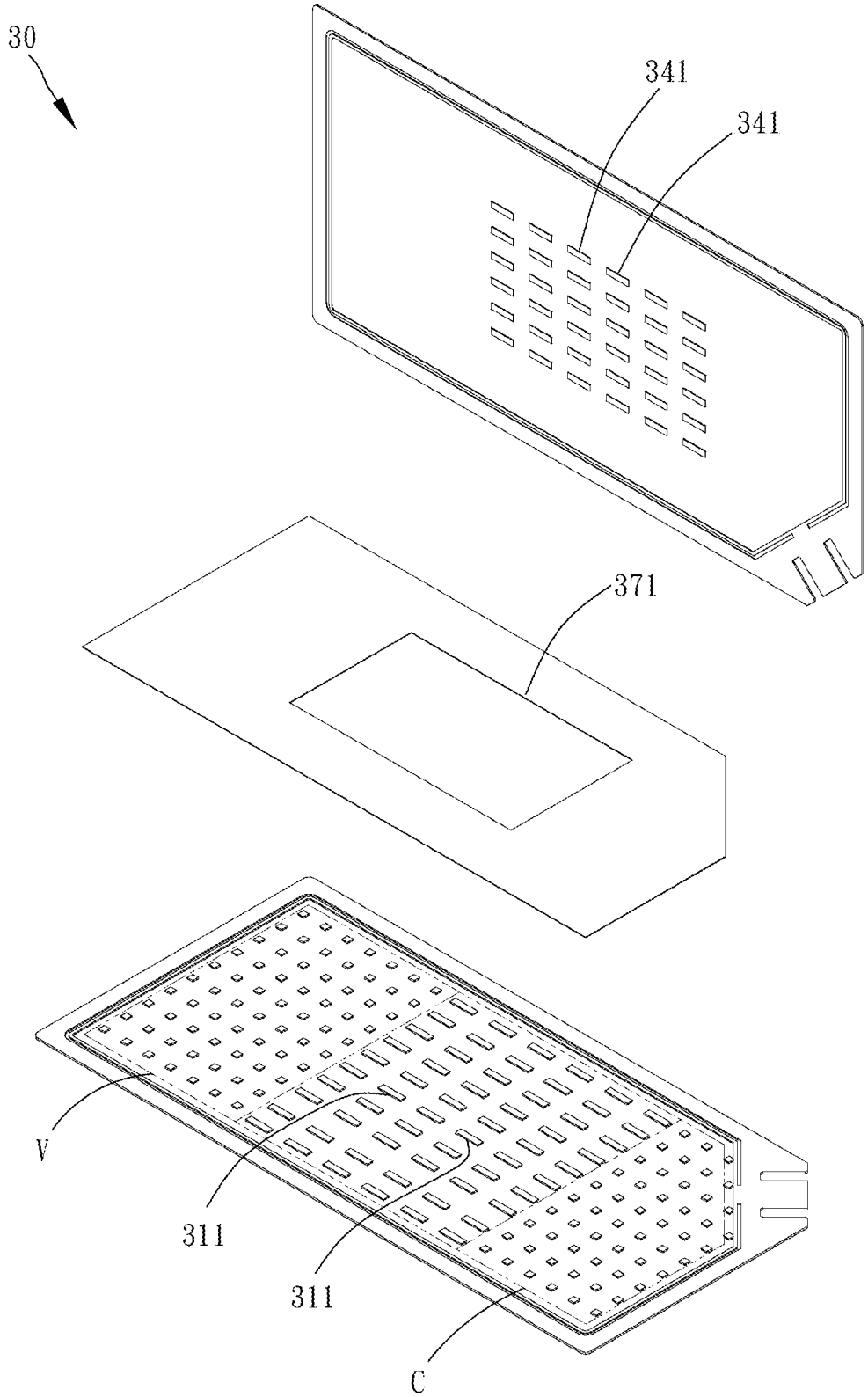
FIG. 7 is an exploded view of a vapor chamber in accordance with a third embodiment of the present invention.

FIG. 7 illustrates a vapor chamber 30 in accordance with a third embodiment of the present invention. This third embodiment is substantially similar to the aforesaid first embodiment with the exceptions as outlined hereinafter.

The first bumps 311 located in the hollow portion 371 are elongated, and the two ends thereof face the evaporation region V and the condensation region C respectively. Further, the first bumps 311 are arranged in multiple rows along the length direction. Further, the second bumps 341 are elongated, and the two ends thereof face the evaporation region V and the condensation region C respectively.

The first bumps 311 and the second bumps 341 are elongated and arranged in multiple rows. Further, the first bumps 311 are abutted against the second bumps 341 so that directional channels can form in the array of bumps 311,341 with the two ends thereof facing the evaporation region V and the condensation region C respectively to provide better effect for guiding the gas phase working fluid.

The remaining structure of this third embodiment and the achievable effects are the same as those of the first embodiment and will not be described again.

Figure 8:
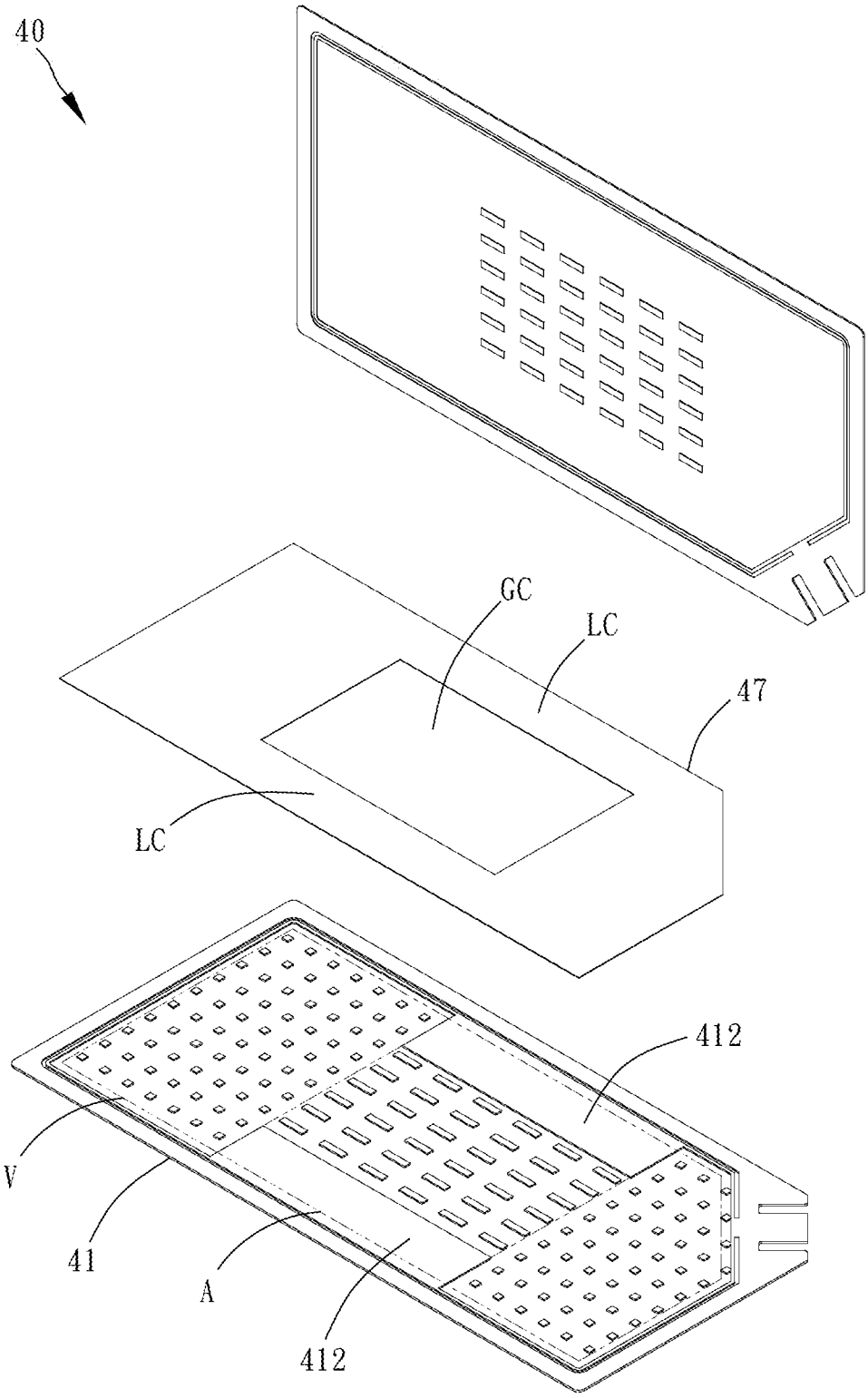
FIG. 8 is an exploded view of a vapor chamber in accordance with a fourth embodiment of the present invention.

FIG. 8 illustrates a vapor chamber 40 in accordance with a fourth embodiment of the present invention. This fourth embodiment is substantially similar to the aforesaid first embodiment with the exceptions as outlined hereinafter.

The first panel 41 comprises two blockers 412 located in the thermal insulation region A. These two blockers 412 are abutted against the capillary material 47 in the thermal insulation region A corresponding to the two liquid channels LC to spatially block the evaporation region V from a part of the thermal insulation region A, making the evaporation region V spatially disconnected from a part of the thermal insulation region A. In this fourth embodiment, the two blockers 412 are boss-shaped and abutted with respective top surfaces thereof against the capillary material 47 in the thermal insulation region A to fill up the space between the capillary material 47 in the thermal insulation region A and the first panel 41.

Based on the structure described above, the two blockers 412 fill up the space between the capillary material 47 in the thermal insulation region A and the first panel 41 to block the gas phase working fluid, forcing the gas phase working fluid to flow from the evaporation region V toward the thermal insulation region A via the vapor channel GC, and simply allowing the liquid phase working fluid to flow back through the two liquid channels LC. Therefore, the fourth embodiment is simpler to guide the flow of the liquid phase working fluid and the gas phase working fluid, and still achieve the effects of the first embodiment described above.

The remaining structure of this fourth embodiment and the achievable effects are the same as those of the first embodiment and will not be described again.

Figure 9:
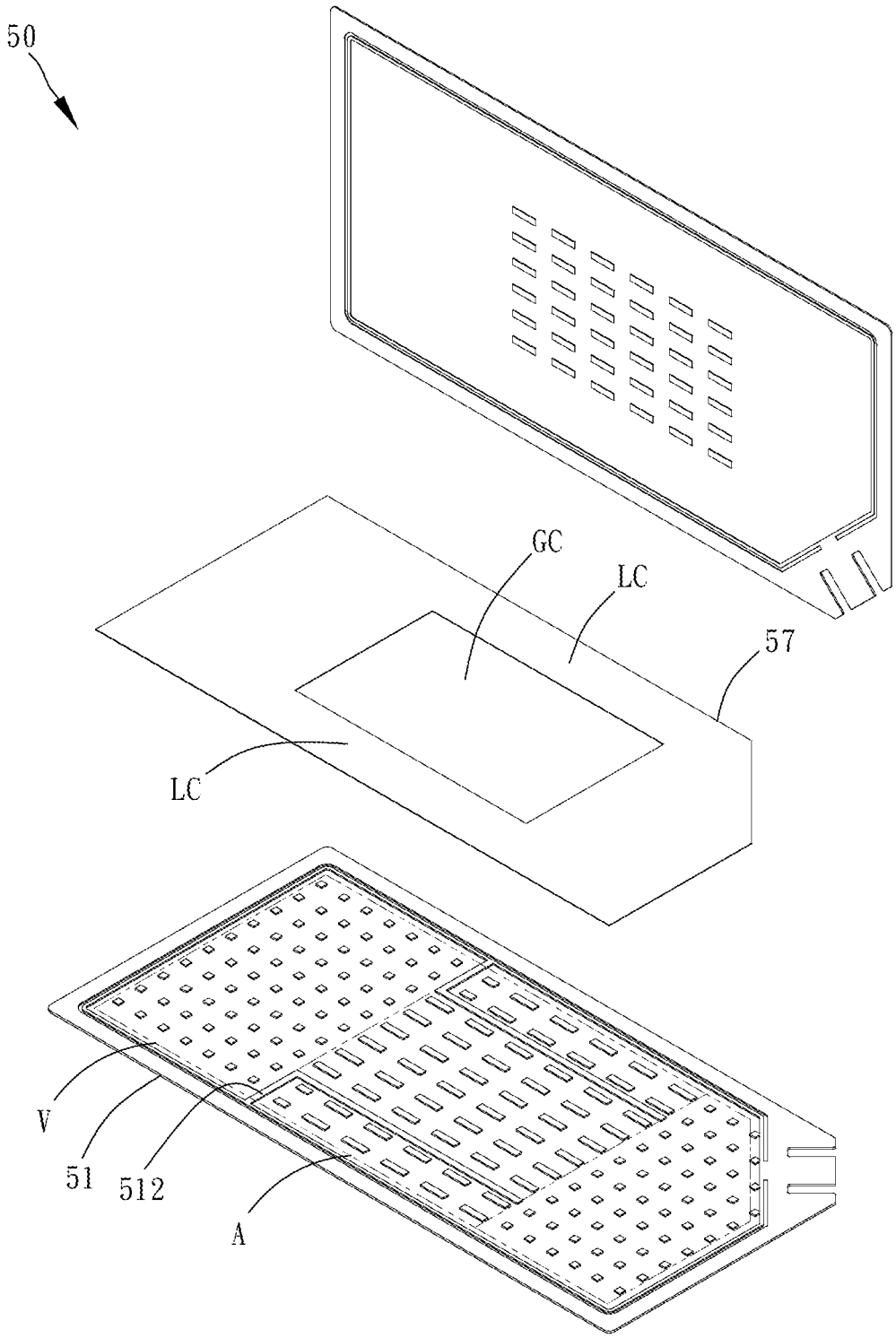
FIG. 9 is an exploded view of a vapor chamber in accordance with a fifth embodiment of the present invention.

FIG. 9 illustrates a vapor chamber 50 in accordance with a fifth embodiment of the present invention. This fifth embodiment is substantially similar to the aforesaid fourth embodiment with the exceptions as outlined hereinafter.

The two blockers 512 are upright walls with respective top edges thereof abutted against the capillary material 57 in the thermal insulation region A to block the space between the first panel 51 and the evaporation region V and capillary material 57 in the thermal insulation region A and also to block the space between the first panel 51 and the vapor channel GC and capillary material 57 in the thermal insulation region A. As illustrated in FIG. 9, these two blockers 512 do not block the space between the evaporation region V and the vapor channel GC.

Thus, when the gas phase working fluid flows from the evaporation region V toward the thermal insulation region A, due to the blockage of the two blockers 512, the gas phase working fluid can simply flow to the vapor channel GC and is prohibited from flowing into the space between the capillary material 57 in the thermal insulation region A and the first panel 51. So far as the liquid phase working fluid is concerned, it can flow back through the two liquid channels LC. Therefore, this fifth embodiment can also achieve the effect of guiding the flow of the liquid phase working fluid and the gas phase working fluid.

The remaining structure of this fifth embodiment and the achievable effects are the same as those of the first embodiment and will not be described again.

What is claimed is:

1. A vapor chamber, comprising:

a first panel defining an evaporation region, a thermal insulation region and a condensation region, said thermal insulation region being adjacent to said evaporation region and said condensation region respectively, said evaporation region and said condensation region being spaced from each other;

a second panel joined to said first panel with an enclosed accommodation space defined therebetween;

a capillary material made in the form of a flake and located in said accommodation space; and a working fluid filled in said accommodation space;

wherein:

said first panel comprises a plurality of first bumps located on a panel surface thereof within said accommodation space and distributed in said evaporation region, said thermal insulation region and said condensation region and abutted against said capillary material;

said capillary material comprises a hollow portion located in said thermal insulation region to expose a part of said first bumps and to define a vapor channel therein, said capillary material having a part thereof located in said thermal insulation region to form at least one liquid channel;

said second panel comprises a plurality of second bumps located on a panel surface thereof within said accommodation space, said second bumps being disposed in said hollow portion to abut against said first bumps.

2. The vapor chamber as claimed in claim 1, wherein the number of said first bumps per unit area within said hollow portion is less than the number of said first bumps per unit area beyond said hollow portion.

3. The vapor chamber as claimed in claim 1, wherein said first bumps in said hollow portion are elongated with respective two opposite ends thereof facing said evaporation region and said condensation region respectively.

4. The vapor chamber as claimed in claim 3, wherein said first bumps are arranged in multiple rows along the length direction thereof.

5. The vapor chamber as claimed in claim 1, wherein said second bumps are elongated with respective two opposite ends thereof facing said evaporation region and said condensation region respectively.

6. The vapor chamber as claimed in claim 1, wherein said first panel further comprises at least one blocker disposed in said thermal insulation region and abutted against said capillary material in said thermal insulation region to spatially block the space between said evaporation region and said thermal insulation region, making said evaporation region spatially disjoint with a part of said thermal insulation region.

7. The vapor chamber as claimed in claim 6, wherein said at least one blocker is boss-shaped and abutted with a top surface thereof against said capillary material in said thermal insulation region to fill up the space between said capillary material in said thermal insulation region and said first panel.

8. The vapor chamber as claimed in claim 6, wherein each said blocker is made in the form of an upright wall and abutted with a top edge thereof against said capillary material in said thermal insulation region.

9. The vapor chamber as claimed in claim 8, wherein said at least one blocker spatially blocks the space between said evaporation region, said capillary material in said thermal insulation region and said first panel and also blocks the space between said vapor channel, said capillary material in said thermal insulation region and said first panel.

* * * * *